US010011400B2

(12) United States Patent
Qian

(10) Patent No.: US 10,011,400 B2
(45) Date of Patent: Jul. 3, 2018

(54) GLUE EXTRUDING DEVICE

(71) Applicant: Ningbo Pasco United Industry Co., Ltd., Yuyao, Zhejiang (CN)

(72) Inventor: Xiaohua Qian, Zhejiang (CN)

(73) Assignee: NINGBO PASCO UNITED INDUSTRY CO., LTD., Yuyao, Zhejiang (CN)

( * ) Notice: Subject to any disclaimer, the term of this patent is extended or adjusted under 35 U.S.C. 154(b) by 0 days.

(21) Appl. No.: 14/758,636

(22) PCT Filed: Apr. 24, 2015

(86) PCT No.: PCT/CN2015/077355

§ 371 (c)(1),
(2) Date: Jun. 30, 2015

(87) PCT Pub. No.: WO2016/090811

PCT Pub. Date: Jun. 16, 2016

(65) Prior Publication Data

US 2017/0267413 A1 Sep. 21, 2017

(30) Foreign Application Priority Data

Dec. 10, 2014 (CN) ..... 2014 1 0751450

(51) Int. Cl.

| | |
|---|---|
| ***B65D 35/28*** | (2006.01) |
| ***B65D 35/56*** | (2006.01) |
| *B65D 35/04* | (2006.01) |
| *B65D 35/38* | (2006.01) |
| *B65D 35/44* | (2006.01) |

(52) U.S. Cl.
CPC ..... *B65D 35/28* (2013.01); *B65D 35/565* (2013.01); *B65D 35/04* (2013.01); *B65D 35/38* (2013.01); *B65D 35/44* (2013.01)

(58) Field of Classification Search
CPC ..... B65D 35/28; B65D 35/565; B65D 35/04; B65D 35/38; B65D 35/44
USPC ..... 222/103, 105
See application file for complete search history.

(56) References Cited

U.S. PATENT DOCUMENTS 4,565,303 A * 1/1986 Gilbertson ..... B65D 35/28 222/103
5,105,984 A * 4/1992 Kazimir ..... B65D 35/28 222/103

(Continued)

FOREIGN PATENT DOCUMENTS

| | | |
|---|---|---|
| CN | 201012065 Y | 1/2008 |
| JP | 5105564 B1 | 12/2012 |
| WO | 2009156109 A1 | 12/2009 |

*Primary Examiner* — Jeremy W Carroll
(74) *Attorney, Agent, or Firm* — Global IP Services; Tianhua Gu

(57) ABSTRACT

A glue extruding device for tube of glue is composed of a base, on which the device is placed vertically; two side plates, of which at least one is pressing plate with extrudable elastic connection to the base and a pressing surface on inner wall to contact outer surface of aluminum tube and facilitate glue extrusion; a retaining clip above the base, with one end to connect to the top of a side plate and a through-hole in the middle from which the mouth of tube can extend out. There is an accommodating cavity between the base, the two side plates and the retaining clip to place and position tube body.

6 Claims, 6 Drawing Sheets

(56) References Cited

U.S. PATENT DOCUMENTS

| | | | | | |
|---|---|---|---|---|---|
| 5,271,529 | A * | 12/1993 | Stuber | B65D 35/28 | 222/103 |
| 5,897,030 | A * | 4/1999 | Stangle | B65D 35/28 | 222/103 |
| 6,315,165 | B1 * | 11/2001 | Regan | B65D 35/28 | 222/103 |
| 6,669,055 | B1 * | 12/2003 | Coleman | B65D 35/28 | 222/103 |
| 9,309,028 | B2 * | 4/2016 | Kealy | B65D 35/28 | |
| 2004/0149864 | A1 * | 8/2004 | D'Carlo | B65D 35/565 | 248/108 |

* cited by examiner

GLUE EXTRUDING DEVICE

CROSS REFERENCE TO RELATED PATENT APPLICATION

The present application is the US national stage of PCT/CN2015/077355 filed on Apr. 24, 2015, which claims the priority of the Chinese patent applications No. 201410751450.4 filed on Dec. 10, 2014, which applications are incorporated herein by reference.

FIELD OF THE INVENTION

The present invention relates to a glue extruding device, more particularly to a glue extruding device for aluminum tube of glue.

BACKGROUND OF THE INVENTION

Currently, while using aluminum tube of glue it is usually to extrude glue with the hand and it needs for direct contact with aluminum tube. The amount of glue which is extruded is relevant to extrusion pressure and it is general to extrude glue with finger top, so it is difficult to accurately control the pressure, which leads to not only the amount of glue being extruded that is inconsistent with actual need but also poor user experience in the process of extrusion. Furthermore, aluminum tube of glue cannot be arranged vertically and for horizontal placement, the mouth of aluminum tube at least partly surrounded by glue in contact area with the cap, which increases the possibility that the mouth is blocked by glue. In addition, aluminum tube of glue is also easy to distort when it is pressed. Aluminum tube will burst and glue will eject under unexpected large pressure to cause skin or eye injury.

Upon search, the Chinese utility model patent numbered CN03209835.9 discloses a pressing type glue tube, comprising a tube body, an upper sleeve, a lower sleeve, an outlet tube and a pressing sheath. A flexible pressing sheath is set outside the upper outlet tube of the tube body, in front of which a pressing plate is set, and on which there is a cover for the outlet tube, and at both side there are limiting shafts. The tube body connects with the upper sleeve through threaded or bayonet joint, and the flexible pressing sheath is made of high strength plastic. But the structure is for single use only: it must be discarded when the glue is used up, relatively wasteful.

In addition, the Chinese utility model patent numbered CN200920074032.0 discloses a device for pressing flexible-tube contained glue, comprising flexible tube and tube mouth, characterized by, outside the said flexible tube there is a pressing box with a roller, which is bigger than the flexible tube in shape, with an opening at its left, in the middle front of it there is a through roller slot, the width of which suits the roller length, at the upper and lower sides, there are long through slots, inclined in the same direction, at the right side, there is a hole less than the shape of the flexible tube but larger than the external diameter of the flexible tube mouth; the length of the said roller slot is less than that of the flexible tube; at both ends of the said roller are cylinders with supporting feet, of which the length is larger than the shape of the flexible tube; the inclination direction of the said long slot is an angle backward at the right side; the length of the supporting feet is larger than the distance from the upper side of the roller slot to the upper side of the pressing box. In this structure, rotating roller will pressing the flexible tube and extrude out the glue in the tube; but, both holding the pressing box and rotating the roller are required in operation, so it is not convenient; moreover, the pressing cannot extrude all glue out when there is a little glue in the flexible tube.

SUMMARY OF THE INVENTION

The invention aims at solving the above technical problems to provide a glue extruding device for tube of glue with simple structure and for convenient use.

Technical solution of the present invention to solve the above technical problems: a glue extruding device for tube of glue, a glue tube and a glue nozzle is disposed in the device, which is characterized by:

A base, on which the glue extruding device is placed vertically; Two side plates, of which the bottom is connected to left side and right side of the base. At least one of them is pressing plate, with extrudable elastic connection to the base. A pressing surface on its inner wall is formed to contact outer surface of tube and facilitate glue extrusion;

A retaining clip above the base, with one end which is connected to the top of a side plate and a through-hole in the middle from which the mouth of tube can extend out. There is an accommodating cavity between the base, the two side plates and the retaining clip to place and position tube body.

As one of the technical solutions, the side plates mentioned can be extruded from one direction. One of the plates is a pressing plate and another is a fixed plate, with a matching surface in the side. One end of the retaining clip is connected to the fixed plate.

As another technical solution, the side plates mentioned can be extruded from two directions. One of the plates is a pressing plate and another is a fixed plate with elastic connection in its side to another pressing plate, of which pressing part is exposed through the opening of fixed plate. One end of the retaining clip is connected to the fixed plate.

As the improvement, the diameter of through-hole is matched with outer diameter of glue nozzle. There is a port in the front side of through-hole to insert the mouth of tube. During installation, the tube is inserted from the side into the area between the side plates of glue extruding device, with its mouth extending outside the retaining clip.

Further improvement, the above pressing surface or matching surface is inclined, with its tilt angle to match with outer surface of the tube. The inclined surface of one side plate is longer than the inclined surface of the other side plate.

Further improvement, there is stepped uneven texture structure at outer side of the pressing plate for easy extrusion and slippage resistance.

As the preferred, the base, two side plates and retaining clip are produced by plastic whole piece integrally molded.

As the preferred, glue tube is aluminum or plastic. Glue nozzle is connected to the mouth of glue tube through screw thread. A cap is covered on glue nozzle. And finally, its base adopts planar structure.

A glue extruding device, characterized by, a base, two side plates, and a retaining clip, the bottom of the side plates connects with both sides of the base, and at least one of the side plates is a pressing plate, which is a flexible plate, and when applied a extrusion pressure inward, flexibly moves inward, and when the extrusion pressure disappears, the pressing plate will recover outward; the retaining clip is on the base, of which one end connects with the upper end of the other side plate, and in the middle of the retaining clip is a through hole for protrusion of the mouth of the glue tube. Between the base, the two side plates and the retaining clip is an accommodating cavity.

As the preferred, a gap between the pressing plate and the retaining clip.

As the preferred, the other side plate is a fixed plate, with a matching surface.

As the preferred, one end of the retaining clip is connected to the fixed plate.

As the preferred, the matching surface is a fixed inclined plat which is connected with the fixed plate in a fixed way.

As the preferred, the matching surface is a flexible inclined plate, one end of which is connected with the fixed plate in a fixed way, and at the other end of which a lateral isolation plate is set, contacting the inner side of the fixed plate.

As the preferred, there is a stepped uneven texture structure at the outer side of the pressing plate for easy extrusion and slippage resistance.

As the preferred, the pressing plate comprises a pressure plate and a bevel plate, between the pressure plate and the bevel plate at least a baffle is set, of which, the part higher than the pressure plate forms the uneven texture structure.

As the preferred, its base, two side plates and retaining clip produced by plastic whole piece integrally molded.

Compared with the prior art, the invention has the advantages that: glue extruding device can be placed vertically, the glue in tube will not contact with its mouth or cap to reduce the possibility that the mouth is blocked by glue; glue extruding device is integrally formed by plastic with convenient manufacture and low cost, and all body of tube can be coated, so that unexpected press or drop will not cause serious deformation or rupture of tube, with obvious protective effect; bevel design is adopted for the areas in contact with tube body for convenient extrusion, a retaining clip is arranged on the mouth for very stable placement, and its operation is simple. With simple structure and convenient use, the present invention can realize completely consistent gesture and method to extrude all glue as usual. Under substantially the same pressure, the amount of glue which is extruded is roughly the same. Not limited to the tube of chemical glue, the glue extruding device can be used for cosmetics glue and medical glue.

DETAIL DESCRIPTION OF THE INVENTION

Figure 1:
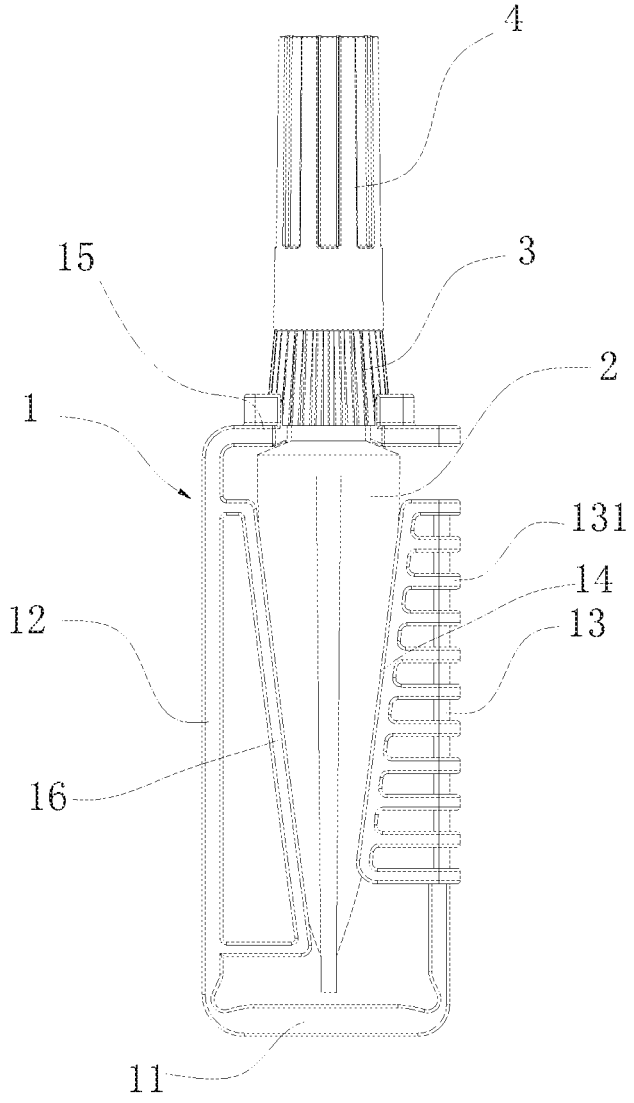
FIG. 1 is schematic structure of Embodiment 1 of the invention.
Figure 2:
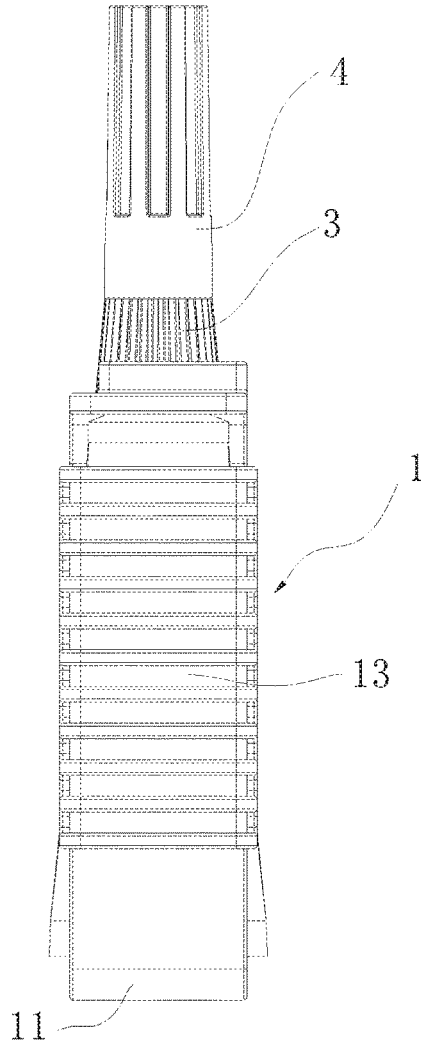
FIG. 2 is a side view of FIG. 1.
Figure 3:
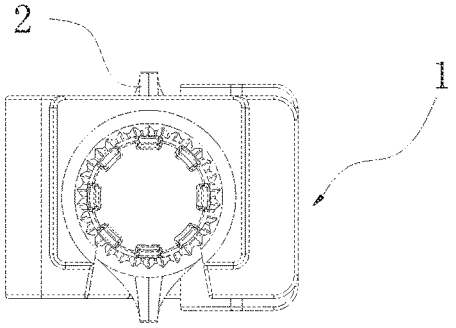
FIG. 3 is a top view of FIG. 1.
Figure 4:
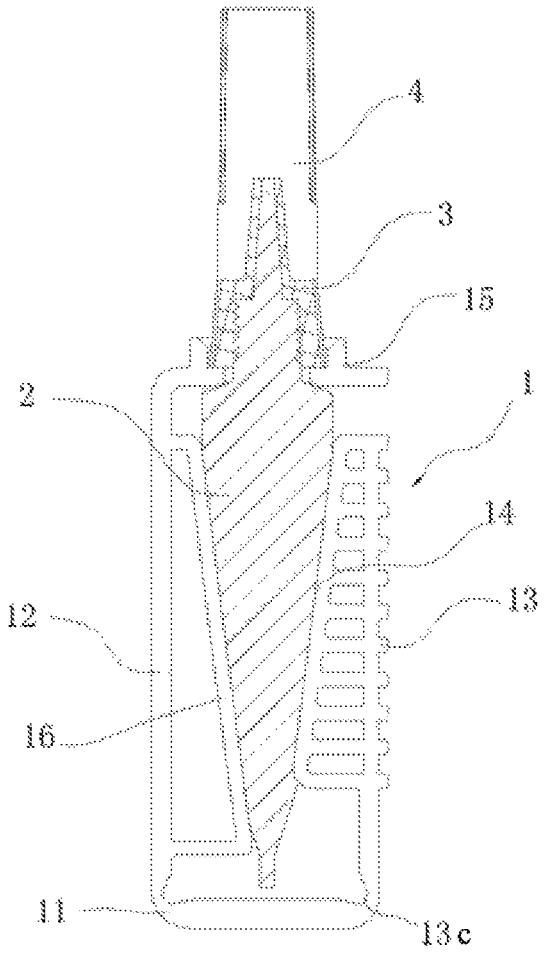
FIG. 4 is a sectional view of FIG. 3 along the line A-A.
Figure 5:
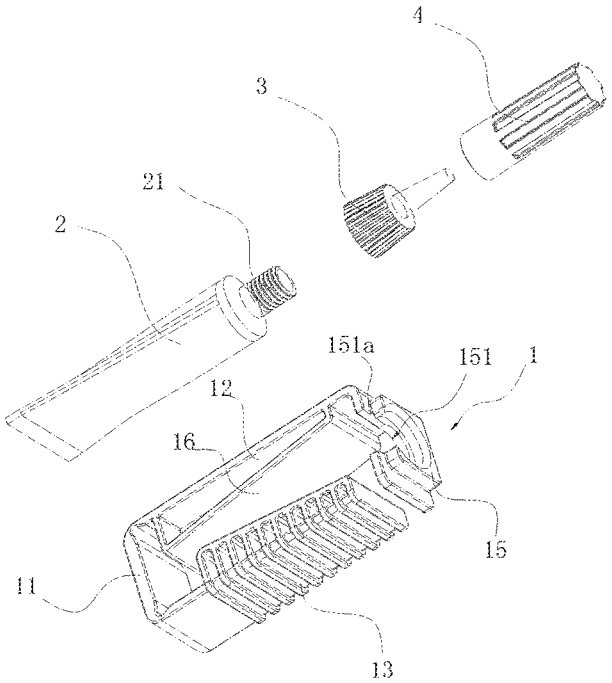
FIG. 5 is an exploded view of FIG. 1.

The present invention will be further described in detail combined with the figures and the embodiments.

Embodiment 1

As shown in FIG. 1-5, glue extruding device 1 for aluminum tube of glue described in this embodiment is composed of a glue tube 2, a glue nozzle 3 and a cap 4 in glue extruding device 1. The tube in this embodiment is aluminum. Glue nozzle 3 is connected to the mouth 21 of glue tube 2 through screw thread. The cap 4 is covered on glue nozzle 3; Glue extruding device 1 adopts clamp tubular structure for lateral extrusion and with opening in front-end and back-end with the same length as glue tube 2. Glue extruding device 1 is integrally formed to be plastic whole piece, which consists of a base 11, two side plates and a retaining clip 15. The base 11 is planar rectangular structure, on which glue extruding device 1 can be placed vertically. In this embodiment, the base 11 adopts plate structure which is relatively simple. It is certain that grid structure can also be used or supporting foot, supporting bar or supporting block can be arranged on bottom surface of the plate; The two side plates are connected at the bottom to left side and right side of the base 11. Using this structure, aluminum tube can be placed vertically and stably, so that the glue in glue tube 2 will not contact with its mouth 21 or cap 4 to reduce the possibility that the mouth 21 is blocked by glue; In this embodiment, the two side plates can be extruded from one direction, one of the plates is a pressing plate 13, with extrudable elastic connection relying mainly on material elastic to the base 11, when it is necessary, the thickness at connection transition region 13*c* can be reduced to make pressing plate 13 be connected to the base and can be extruded inward through elastic deformation, another side plate is a fixed plate 12 with respect to pressing plate 13 to achieve fixation, in use, pressing plate 13 is pressed inward to extrude glue, pressing plate 13 is designed to realize the function to extrude all glue but do not need to completely squash glue tube 2, this is mainly because there is air in glue tube 2, residual air in the tube can squeeze out all the remaining glue without waste and user is not required to take out glue tube 2 and extrude glue with hands, and under substantially the same pressure, the amount of glue which is extruded is roughly the same; An inclined pressing surface 14 on inner wall of pressing plate 13 is formed to contact outer surface of glue tube 2 and facilitate glue extrusion. There is a matching surface 16 in the side of fixed plate 12, which is also inclined and composed of an inclined baffle in the side of fixed plate 12. Pressing surface 14 and matching surface 16 are smooth slope to make a full contact with outer wall of glue tube 2. The tilt angle is matched with glue tube 2. The inclined surface of fixed plate 12 is longer than the inclined surface of pressing plate 13 to increase contact area of glue extruding device 1 and glue tube 2 to the greatest extent. It is helpful to uniformly distribute extrusion strength and stably place glue tube 2; Retaining clip 15, with one end to connect to the top of fixed plate 12 and a circular through-hole 151 in the middle from which the mouth of glue tube 2 can extend out, is arranged above the base 11. The diameter of circular through-hole 151 is matched with outer diameter of glue nozzle 3. There is an accommodating cavity between the base 11, the two side plates and the retaining clip 15 to place and position the body of glue tube 2 to form clamp tubular structure with the same length as glue tube 2 for lateral extrusion and with opening in front-end and back-end. Glue extruding device 1 is integrally formed to be plastic whole piece. There is a port 151*a* in the front of circular through-hole 151 to insert the mouth 21 of glue tube 2. The width of port 151*a* is slightly less than outer diameter of glue nozzle 3. During installation, glue tube 2 is inserted from the side into the area between the side plates of glue extruding device 1, with the mouth 21 extending outside the retaining clip 15 and with threaded connection to glue nozzle 3 and mouth 21. Glue extruding device 1 covers all the body of glue tube 2, so that unexpected press or drop will not cause serious deformation or rupture of glue tube 2, with obvious protective effect; For ease of operation, there is stepped uneven texture structure 131 on outer side of pressing plate 13 for both slippage resistance and artistic appearance because pressing plate 13 is in contact with the fingers of user on the outside. In operation, place glue tube 2 with glue into the device, press its pressing plate 13 on the outside as usual and stop pressing after the amount of glue being extruded is enough. Remove glue tube 2 after the glue in it is used up and place a new glue tube in it for repeated use.

The operation for the embodiment is simple and easy to understand. It takes only two seconds to place glue tube into this device. And users need no instruction to use this device well. It is very easy to use for gesture and method to extrude glue is exactly the same as ordinary use.

Embodiment 2

Figure 6:
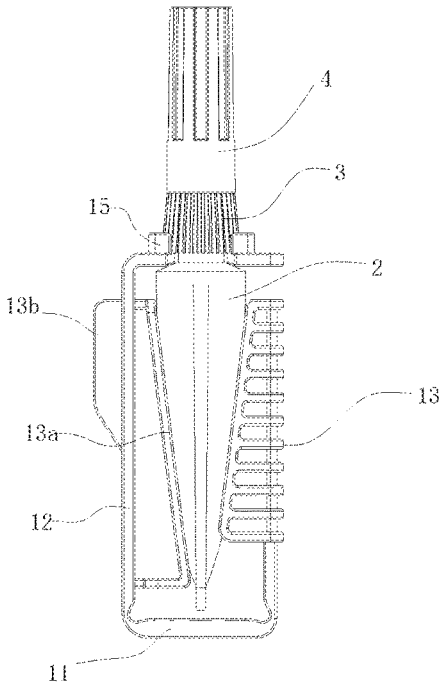
FIG. 6 is schematic structure of Embodiment 2 of the invention.
Figure 7:
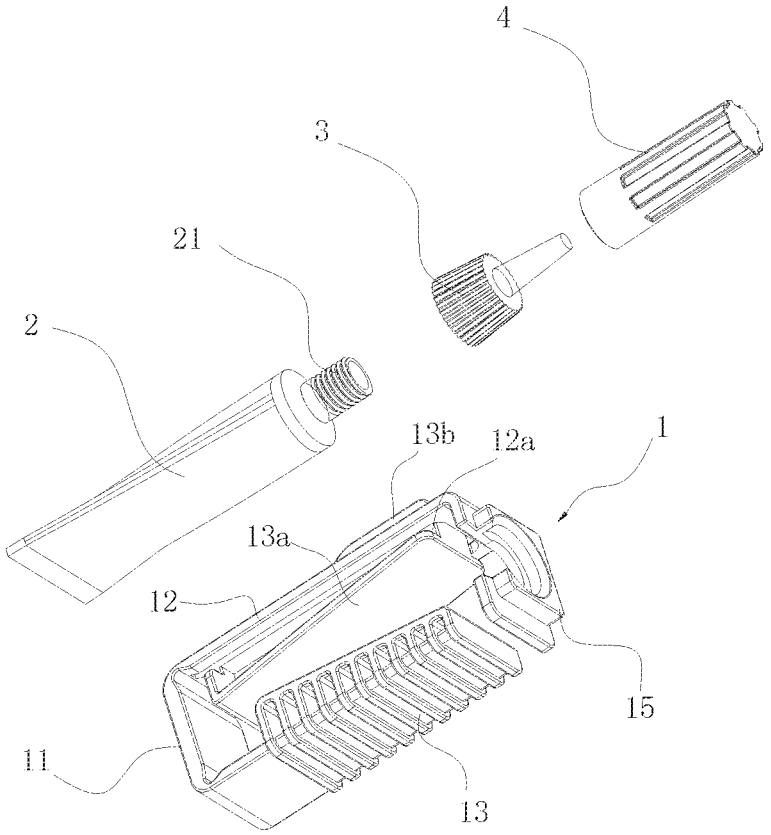
FIG. 7 is exploded schematic structure of Embodiment 2 of the invention.

As shown in FIG. 6-7, Embodiment 2 differs from Embodiment 1 in that side plates of glue extruding device 1 can be extruded from two directions. One of the plates is a pressing plate 13 with extrudable elastic connection to the base 11 and another is a fixed plate 12 with elastic connection in its side to another pressing plate 13*a*, pressing part 13*b* of pressing plate 13*a* is exposed through the opening 12*a* of fixed plate 12. One end of the retaining clip 15 is connected to upper end of fixed plate 12. Pressing surface of pressing plate 13 is inclined, with its tilt angle to match with outer surface of the tube. And the inclined surface of one side plate is longer than the inclined surface of the other side plate. During extrusion, both sides can be pressed inward to extrude glue. Other design is similar with Embodiment 1.

Embodiment 3

Figure 8:
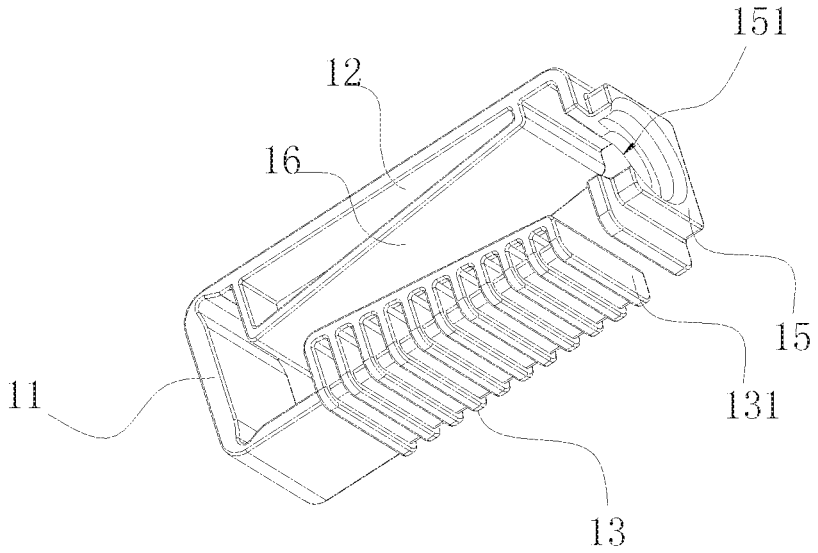
FIG. 8 is schematic structure of Embodiment 3 of the invention.

A glue extruding device, as shown in FIG. 8, comprises of a base 11, two side plates, and a retaining clip 15; the bottom of the side plates connects with both sides of the base 11, and at least one of the side plates is a pressing plate 13. The base 11 of the glue extruding device enable it to be placed vertically, so the glue in the glue tube will not contact the mouth and the cap, reducing the possibility of the glue blocking the mouth. The pressing plate 13 is a flexible plate, which, when applied an extrusion pressure inward, flexibly moves inward and presses the glue placed between; when the extrusion pressure disappears, the pressing plate 13 will recover outward, and the pressure imposed on the glue in the tube will disappear as well. The retaining clip 15 is on the base 11. One end of the retaining clip 15 connects with the upper end of the other side plate, and in the middle of the retaining clip 15 is a through hole 151 for protrusion of the mouth of the glue tube. Between the base 11, the two side plates and the retaining clip 15 is an accommodating cavity.

A gap 17 is set between the end of the pressing plate 13 and the retaining clip 15, that is, there is a space between the pressing plate 13 and the retaining clip 15, so the both are not connected, guaranteeing that the pressing plate 13 may deform flexibly to press out the glue.

The other side plate is a fixed plate 12, of which there is a matching surface 16, contacting the glue tube directly. One end of the retaining clip 15 connects with the fixed plate. The matching surface 16 is a fixed inclined plate which connects with the fixed plate 12 in a fixed way. The structure is extruded from one direction, only the pressing plate 13 can deform flexibly to press out the glue. Bevel design is adopted for the areas in contact with tube body for convenient extrusion, a retaining clip is arranged on the mouth for very stable placement, and its operation is simple.

There is a stepped uneven texture structure 131 at outer side of the pressing plate 13 for easy extrusion and slippage resistance. The detailed structure is: the pressing plate 13 comprises a pressure plate 132 and a bevel plate, between the pressure plate 132 and the bevel plate 133 at least a baffle 134 is set, of which, the part higher than the pressure plate 132 forms the uneven texture structure 131.

The base 11, two side plates and retaining clip 15 are produced by plastic whole piece integrally molded. The glue extruding device is integrally formed by plastic with convenient manufacture and low cost, and all body of tube can be coated, so that unexpected press or drop will not cause serious deformation or rupture of tube, with obvious protective effect.

With simple structure and convenient use, the present invention can realize completely consistent gesture and method to extrude all glue as usual. Under substantially the same pressure, the amount of glue which is extruded is roughly the same. Not limited to the tube of chemical glue, the glue extruding device can be used for cosmetics glue and medical glue.

Embodiment 4

Figure 9:
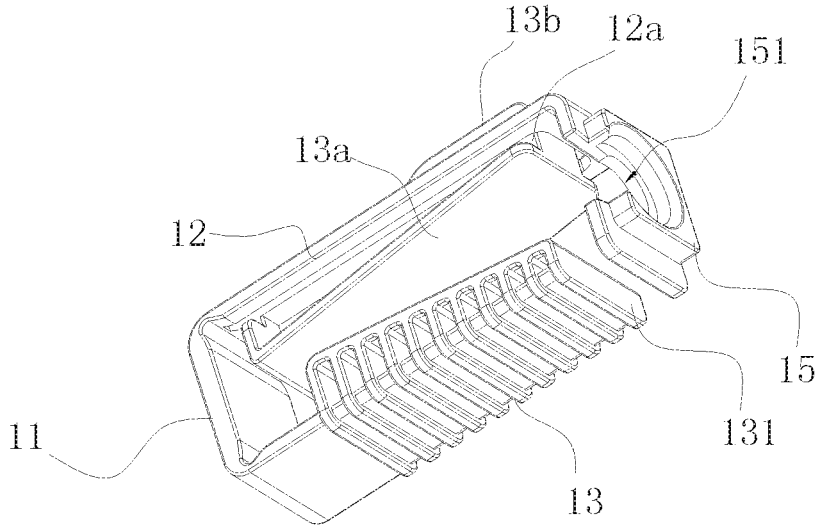
FIG. 9 is schematic structure of Embodiment 4 of the invention.

A glue extruding device, as shown in FIG. 9, comprises of a base 11, two side plates, and a retaining clip 15; the bottom of the side plates connects with both sides of the base 11, and at least one of the side plates is a pressing plate 13. The base 11 of the glue extruding device enable it to be placed vertically, so the glue in the glue tube will not contact the mouth and the cap, reducing the possibility of the glue blocking the mouth. The pressing plate 13 is a flexible plate, which, when applied an extrusion pressure inward, flexibly moves inward and presses the glue placed between; when the extrusion pressure disappears, the pressing plate 13 will recover outward, and the pressure imposed on the glue in the tube will disappear as well. The retaining clip 15 is on the base 11. One end of the retaining clip 15 connects with the upper end of the other side plate, and in the middle of the retaining clip 15 is a through hole 151 for protrusion of the mouth of the glue tube. Between the base 11, the two side plates and the retaining clip 15 is an accommodating cavity.

A gap 17 is set between the end of the pressing plate 13 and the retaining clip 15, that is, there is a space between the pressing plate 13 and the retaining clip 15, so the both are not connected, guaranteeing that the pressing plate 13 may deform flexibly to press out the glue.

The other side plate is a fixed plate 12, of which there is a matching surface 16, contacting the glue tube directly. One end of the retaining clip 15 is connected to the fixed plate. The matching surface 16 is a flexible inclined plate, one end of which connects with the fixed plate 12 in a fixed way, and at the other end of which a lateral isolation plate 191 is set, contacting the inner side to the fixed plate 12. When the structure is subjected to a pressure, the lateral isolation plate 191 and the pressing plate will deform flexibly to press out the glue in both directions. Bevel design is adopted for the areas in contact with tube body for convenient extrusion, a retaining clip is arranged on the mouth for very stable placement, and its operation is simple.

There is a stepped uneven texture structure 131 at outer side of the pressing plate 13 for easy extrusion and slippage resistance. The detailed structure is: the pressing plate 13 comprises a pressure plate 132 and a bevel plate, between the pressure plate 132 and the bevel plate 133 at least a baffle 134 is set, of which, the part higher than the pressure plate 132 forms the uneven texture structure 131.

The base 11, two side plates and retaining clip 15 are produced by plastic whole piece integrally molded. The glue extruding device is integrally formed by plastic with convenient manufacture and low cost, and all body of tube can be coated, so that unexpected press or drop will not cause serious deformation or rupture of tube, with obvious protective effect.

With simple structure and convenient use, the present invention can realize completely consistent gesture and method to extrude all glue as usual. Under substantially the same pressure, the amount of glue which is extruded is roughly the same. Not limited to the tube of chemical glue, the glue extruding device can be used for cosmetics glue and medical glue.

The above are only the preferred embodiments of the invention. It should be pointed out that any improvements or modifications that a common person skilled in the relevant field makes based on technical principle of the invention shall be considered in the scope of the present invention.

What is claimed is:

1. A glue extruding device for a glue tube with a glue nozzle comprising:

a base;

a pressing plate, which is vertically extended from a first side of the base and is elastically connected with the base;

a fixed plate with a pressing part, which is vertically extended from a second side of the base which is opposite the first side, the fixed plate has a opening, the pressing part is exposed through the opening, the pressing part is elastically connected with the base;

a retaining clip located above the base with one end connected to a top of the fixed plate, the retaining clip has a through-hole for extending a mouth of the glue tube out from the retaining clip;

an inner wall of the pressing plate, an inner wall of the pressing part of the fixed plate and the retaining clip define an accommodating cavity for holding and contacting the glue tube.

2. The glue extruding device according to claim 1, wherein the through-hole having a diameter matched with an outer diameter of the glue nozzle, there is a port in front of the through-hole for inserting the mouth of the glue tube into the through-hole.

3. The glue extruding device according to claim 1, wherein the inner wall of the pressing plate and the inner wall of the pressing part of the fixed plate have a tilt angle to match with an outer surface of the glue tube, the inner wall of the pressing part of the fixed plate is longer than the inner wall of the pressing plate.

4. The glue extruding device according to claim 1, wherein an outer side of the pressing plate has a stepped uneven texture structure for easy extrusion and slippage resistance.

5. The glue extruding device according to claim 1, wherein the base, pressing plate, fixed plate, pressing part and retaining clip are made by plastic material.

6. The glue extruding device according to claim 1, wherein the base is a planar structure.

* * * * *